US009613771B2

(12) United States Patent
Lim

(10) Patent No.: US 9,613,771 B2
(45) Date of Patent: Apr. 4, 2017

(54) RELAY

(71) Applicant: LSIS CO., LTD., Anyang-si, Gyeonggi-do (KR)

(72) Inventor: Soo Hyun Lim, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 58 days.

(21) Appl. No.: 14/589,820

(22) Filed: Jan. 5, 2015

(65) Prior Publication Data

US 2015/0213982 A1 Jul. 30, 2015

(30) Foreign Application Priority Data

Jan. 28, 2014 (KR) ..... 10-2014-0010707

(51) Int. Cl.
*H01H 50/54* (2006.01)
*H01H 1/54* (2006.01)
*H01H 1/20* (2006.01)

(52) U.S. Cl.
CPC ..... *H01H 50/54* (2013.01); *H01H 1/54* (2013.01); *H01H 50/546* (2013.01); *H01H 2001/2033* (2013.01)

(58) Field of Classification Search
CPC ..... H01H 77/101; H01H 1/54; H01H 50/54; H01H 2001/2033; H01H 50/546
See application file for complete search history.

(56) References Cited

U.S. PATENT DOCUMENTS 1,552,271 A * 9/1925 Burnham ..... H01H 1/54 200/278
1,762,604 A * 6/1930 Ainsworth ..... H01H 1/54 218/110
1,768,536 A * 7/1930 Ainsworth ..... H01H 1/54 200/243

(Continued)

FOREIGN PATENT DOCUMENTS

CN 103843099 6/2014
EP 0561485 9/1993

(Continued)

OTHER PUBLICATIONS

European Patent Office Application Serial No. 15151264.7, Search Report dated Jun. 25, 2015, 7 pages.

(Continued)

*Primary Examiner* — Mohamad Musleh
(74) *Attorney, Agent, or Firm* — Lee Hong Degerman Kang & Waimey

(57) ABSTRACT

Disclosed is a relay. The relay includes a first fixed contact connected to a power source, a second fixed contact separated from the first fixed contact, and connected to a load, and a moving contact configured to be brought into contact with or separated from the first fixed contact and the second fixed contact. The moving contact includes a first moving contact configured to be brought into contact with or separated from the first fixed contact and the second fixed contact and a second moving contact separated from the first moving contact, and configured to be brought into contact with or (Continued)

separated from the first fixed contact and the second fixed contact. Accordingly, the moving contact can be prevented from being separated from the fixed contact by an inter-electron repulsion.

9 Claims, 7 Drawing Sheets

(56) References Cited

U.S. PATENT DOCUMENTS

| | | | | | |
|---|---|---|---|---|---|
| 1,827,430 | A * | 10/1931 | Greenwood | H01H 1/54 | 200/276 |
| 1,832,897 | A * | 11/1931 | Everett | H01H 1/54 | 200/278 |
| 2,871,320 | A * | 1/1959 | Bardorf | H01H 1/54 | 218/15 |
| 2,897,408 | A * | 7/1959 | Kesselring | H01H 1/50 | 335/195 |
| 3,154,662 | A * | 10/1964 | Heupel et al. | H01H 1/20 | 200/243 |
| 9,013,253 | B2 * | 4/2015 | Uchida | H01H 1/54 | 335/131 |
| 2014/0176267 | A1 * | 6/2014 | Hirabayashi | H01H 50/54 | 335/127 |
| 2015/0213982 | A1 | 7/2015 | Lim | | |

FOREIGN PATENT DOCUMENTS

| | | |
|---|---|---|
| JP | 39-1276 | 2/1989 |
| JP | 1-253139 | 10/1989 |
| JP | 2012-28252 | 2/2012 |
| JP | 12/080091 | 6/2012 |
| JP | 2012-243584 | 12/2012 |
| JP | 2013-175437 | 9/2013 |
| JP | 2013-191326 | 9/2013 |
| WO | 2013/051264 | 4/2013 |

OTHER PUBLICATIONS

Korean Intellectual Property Office Application Serial No. 10-2014-0010707, Notice of Allowance dated Jul. 29, 2015, 2 pages.

Korean Intellectual Property Office Application Serial No. 10-2014-0010707, Office Action dated Dec. 30, 2014, 5 pages.

Japan Patent Office Application Serial No. 2015-012145, Office Action dated Jan. 12, 2016, 4 pages.

The State Intellectual Property Office of the People's Republic of China Application Serial No. 201510091263.2, Office Action dated Jul. 8, 2016, 6 pages.

Japan Patent Office Application Serial No. 2015-012145, Notice of Allowance dated Aug. 30, 2016, 3 pages.

* cited by examiner

RELAY

CROSS-REFERENCE TO RELATED APPLICATION

Pursuant to 35 U.S.C. §119(a), this application claims the benefit of earlier filing date and right of priority to Korean Application No. 10-2014-0010707, filed on Jan. 28, 2014, the contents of which is incorporated by reference herein in its entirety.

BACKGROUND OF THE DISCLOSURE

1. Field of the Disclosure

The present disclosure relates to a relay, and particularly, to a relay that prevents a moving contact from deviating from a fixed contact due to inter-electron repulsion.

2. Background of the Disclosure

As well known, an electronic switching device is a type of electrical contact switching device that supplies or cuts off a current, and may be applied to various industrial equipment, machines, and vehicles.

FIG. 1 is a cross-sectional view illustrating a related art relay.

As illustrated in FIG. 1, the related art relay includes a contact part 20, which switches on or off an internal circuit of an external box, and a driver 10 that drives the contact part 20.

The contact part 20 includes a power fixed contact 22, a load fixed contact 24, and a moving contact 26 which is attached to or detached from the power fixed contact 22 and the load fixed contact 24 (hereinafter referred to as fixed contacts).

The driver 10 is configured with, for example, an actuator that generates a driving force with an electric force.

In more detail, the driver 10 is configured with a solenoid that includes a coil 12 that generates a magnetic force with power applied thereto to form a magnetic field space, a fixed core 14 that is fixedly disposed in the magnetic field space formed by the coil 12, a movable core 16 that is movably disposed in the magnetic field space so as to approach or be separated from the fixed core 14, and a shaft 18 that mechanically connects the movable core 16 to the moving contact 26.

One end of the shaft 18 is coupled to the movable core 16, and the other end is connected to the moving contact 26 through the fixed core 14.

In this case, a through hole 14*a* may be formed at a center of the fixed core 14 in order for the shaft 18 to pass through the through hole 14*a*.

A return spring 15, which applies an elastic force in a direction where the movable core 16 deviates from the fixed core 14, is provided between the fixed core 14 and the movable core 16.

Hereinafter, operational effects of the related art relay will be described.

When power is applied to the coil 12, the coil 12 generates a magnetic force.

The movable core 16 is moved by the magnetic force in a direction (i.e., a direction (an up direction in the drawing) approaching the fixed core 14) where a magnetic resistance is reduced.

In this case, the return spring 15 is charged between the fixed core 14 and the movable core 16.

The shaft 18 is moved, by a movement of the movable core 16, in a direction (an up direction in the drawing) where the other end of the shaft 18 deviates from the fixed core 14.

The moving contact 26 is moved, by a movement of the shaft 18, in a direction (an up direction in the drawing) contacting the fixed contacts 22 and 24, and thus contacts the fixed contacts 22 and 24.

When the moving contact 26 contacts the fixed contacts 22 and 24, a circuit is connected in order for a current to flow, the current applied to a power source is supplied to a load through the power fixed contact 22, the moving contact 26, and the load fixed contact 24.

When the supply of power to the coil 12 is stopped, generation of a magnetic force by the coil 12 is stopped.

When generation of the magnetic force by the coil 12 is stopped, the movable core 16 is moved, by an elastic force of the return spring 15, in a direction (a down direction in the drawing) deviating from the fixed core 14.

In this case, the return spring 15 is discharged between the fixed core 14 and the movable core 16.

The shaft 18 is moved, by a movement of the movable core 16, in a direction (a down direction in the drawing) where the other end of the shaft 18 approaches the fixed core 14.

The moving contact 26 is moved, by a movement of the shaft 18, in a direction (a down direction in the drawing) deviating from the fixed contacts 22 and 24, and thus is detached from the fixed contacts 22 and 24.

When the moving contact 26 is detached from the fixed contacts 22 and 24, a circuit is broken, and thus, the supply of power is stopped.

However, in the related art relay, when a short circuit current occurs, the moving contact 26 deviates from the fixed contacts 22 and 24 due to inter-electron repulsion.

Therefore, a pickup voltage increases, and the driver 10 is driven with the increased pickup voltage so that the moving contact 26 does not deviate from the fixed contacts 22 and 24 due to the inter-electron repulsion. However, considerable electric energy is consumed when driving the driver 10 with the increased pickup voltage.

SUMMARY OF THE DISCLOSURE

Therefore, an aspect of the detailed description is to provide a relay that prevents a moving contact from deviating from a fixed contact due to inter-electron repulsion.

Another aspect of the detailed description is to provide a relay that prevents a moving contact from deviating from a fixed contact due to inter-electron repulsion even without increasing a pickup voltage of a driver which drives the moving contact.

To achieve these and other advantages and in accordance with the purpose of this specification, as embodied and broadly described herein, a relay includes: a first fixed contact connected to a power source; a second fixed contact separated from the first fixed contact, and connected to a load; and a moving contact configured to be brought into contact with or separated from the first fixed contact and the second fixed contact, wherein the moving contact includes: a first moving contact configured to be brought into contact with or separated from the first fixed contact and the second fixed contact; and a second moving contact separated from the first moving contact, and configured to be brought into contact with or separated from the first fixed contact and the second fixed contact.

According to an embodiment of the present invention, when the first moving contact and the second moving contact contact the first fixed contact and the second fixed contact, a Lorentz force may be applied to the first moving contact by a current passing through the first moving contact and a current passing through the second moving contact, and the first moving contact may be moved in the same direction as a direction of the Lorentz force applied to the first moving contact, and may contact the first fixed contact and the second fixed contact.

The first fixed contact may include: a first body part to which a current is applied; and a first arm part configured to protrude from the first body part toward the second fixed contact.

The second fixed contact may include: a second body part configured to output a current; and a second arm part configured to protrude from the second body part toward the first fixed contact.

The first moving contact may contact the first body part and the second body part in a state where the first moving contact is separated from the first arm part and the second arm part.

The second moving contact may protrude from the first moving contact to the first arm part and the second arm part, and contact the first arm part and the second arm part.

One of the first body part and the first moving contact may include a first contact end portion that protrudes toward the other of the first body part and the first moving contact.

One of the second body part and the first moving contact may include a second contact end portion that protrudes toward the other of the second body part and the first moving contact.

The first arm part may protrude from one side of the first body part which is separated from the first moving contact when the first moving contact contacts the first body part.

The second arm part may protrude from one side of the second body part which is separated from the first moving contact when the first moving contact contacts the second body part.

A through hole, through which the second moving contact passes, may be formed at one side of the first moving contact.

The second moving contact may protrude from the first moving contact to the first arm part and the second arm part.

According to an aspect of the present invention, the first fixed contact, the second fixed contact, and the first moving contact may be provided so that when the first moving contact and the second contact contact the first fixed contact and the second fixed contact, the first moving contact is provided close to the first arm part and the second arm part within a range in which a current does not flow between the first moving contact and the first arm part and between the first moving contact and the second arm part.

According to another aspect of the present invention, the first arm part, the second arm part, and the first moving contact may be provided vertically to a moving axis of the first moving contact.

In this case, the first moving contact may be disposed in parallel with the first arm part and the second arm part.

According to another aspect of the present invention, the first arm part and the second arm part may protrude in an axial direction crossing the first body part and the second body part.

In this case, the first moving contact may extend in one axis direction.

According to another aspect of the present invention, the first arm part, the second arm part, and the first moving contact may be long formed within a range which is allowed in a limit space.

In this case, the first contact end portion may be provided at or contacts one side of the first body part which is farthest away from an end of the first arm part.

Moreover, the second contact end portion may be provided at or contacts one side of the second body part which is farthest away from the end of the second arm part.

Moreover, the second moving contact may contact the end of the first arm part and an end of the second arm part.

In the present embodiment, the first moving contact and the second moving contact may be driven by a driver.

The driver may include: a coil configured to generate a magnetic force with power applied thereto to form a magnetic field space; a fixed core fixedly disposed in the magnetic field space; a movable core movably disposed in the magnetic field space to approach or be separated from the fixed core; and a shaft configured to connect the movable core to the first moving contact and the second moving contact.

The shaft may include: a first contact spring configured to support the first moving contact; and a second contact spring configured to support the second moving contact.

According to another embodiment of the present invention, when the first moving contact and the second moving contact contact the first fixed contact and the second fixed contact, a Lorentz force may be applied to the first moving contact by a current passing through the first moving contact and a current passing through the second moving contact, and a Lorentz force may be applied to the second moving contact by the current passing through the first moving contact and the current passing through the second moving contact.

In this case, the first moving contact may be moved in the same direction as a direction of the Lorentz force applied to the first moving contact, and may contact the first fixed contact and the second fixed contact.

Moreover, the second moving contact may be moved in the same direction as a direction of the Lorentz force applied to the second moving contact, and may contact the first fixed contact and the second fixed contact.

According to an aspect of the present invention, the first fixed contact, the second fixed contact, the first moving contact and the second moving contact may be provided so that when the first moving contact and the second moving contact contact the first fixed contact and the second fixed contact, the first moving contact and the second moving contact are provided close to each other within a range in which a current does not flow between the first moving contact and the second moving contact.

According to another aspect of the present invention, the first moving contact may be provided vertically to a moving axis of the first moving contact.

In this case, the second moving contact may be provided vertically to a moving axis of the second moving contact.

Moreover, the moving axis of the first moving contact and the moving axis of the second moving contact may be disposed on the same axis.

Moreover, the first moving contact and the second moving contact may be disposed in parallel.

According to another aspect of the present invention, each of the first moving contact and the second moving contact may extend in a straight-line direction.

According to another aspect of the present invention, the first moving contact and the second moving contact may be long formed within a range which is allowed in a limit space.

In this case, the first fixed contact may contact one end of the first moving contact and one end of the second moving contact.

Moreover, the second fixed contact may contact the other end of the first moving contact and the other end of the second moving contact.

In the present embodiment, the first moving contact and the second moving contact may be driven by a driver.

The driver may include: a coil configured to generate a magnetic force with power applied thereto to form a magnetic field space; a fixed core fixedly disposed in the magnetic field space; a first movable core movably disposed in the magnetic field space to approach or be separated from the fixed core; a second movable core movably disposed in the magnetic field space to approach or be separated from the fixed core at a side opposite to the first movable core with respect to the fixed core; a first shaft configured to connect the first movable core to the first moving contact; and a second shaft configured to connect the second movable core to the second moving contact.

The first shaft may include a first contact spring configured to support the first moving contact.

The second shaft may include a second contact spring configured to support the second moving contact.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings:

FIG. 5 is seen from a side; and

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, embodiments of the present invention will be described in detail with reference to the accompanying drawings.

Figure 1:
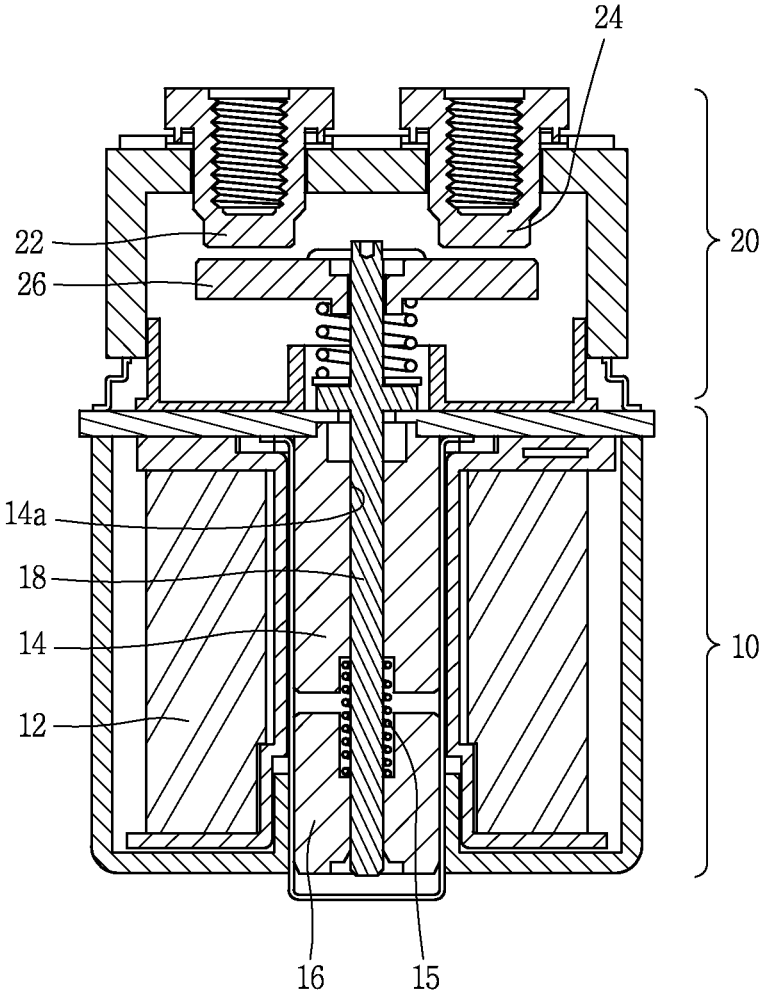
FIG. 1 RELATED ART
FIG. 1 is a cross-sectional view illustrating a related art relay.
Figure 2:
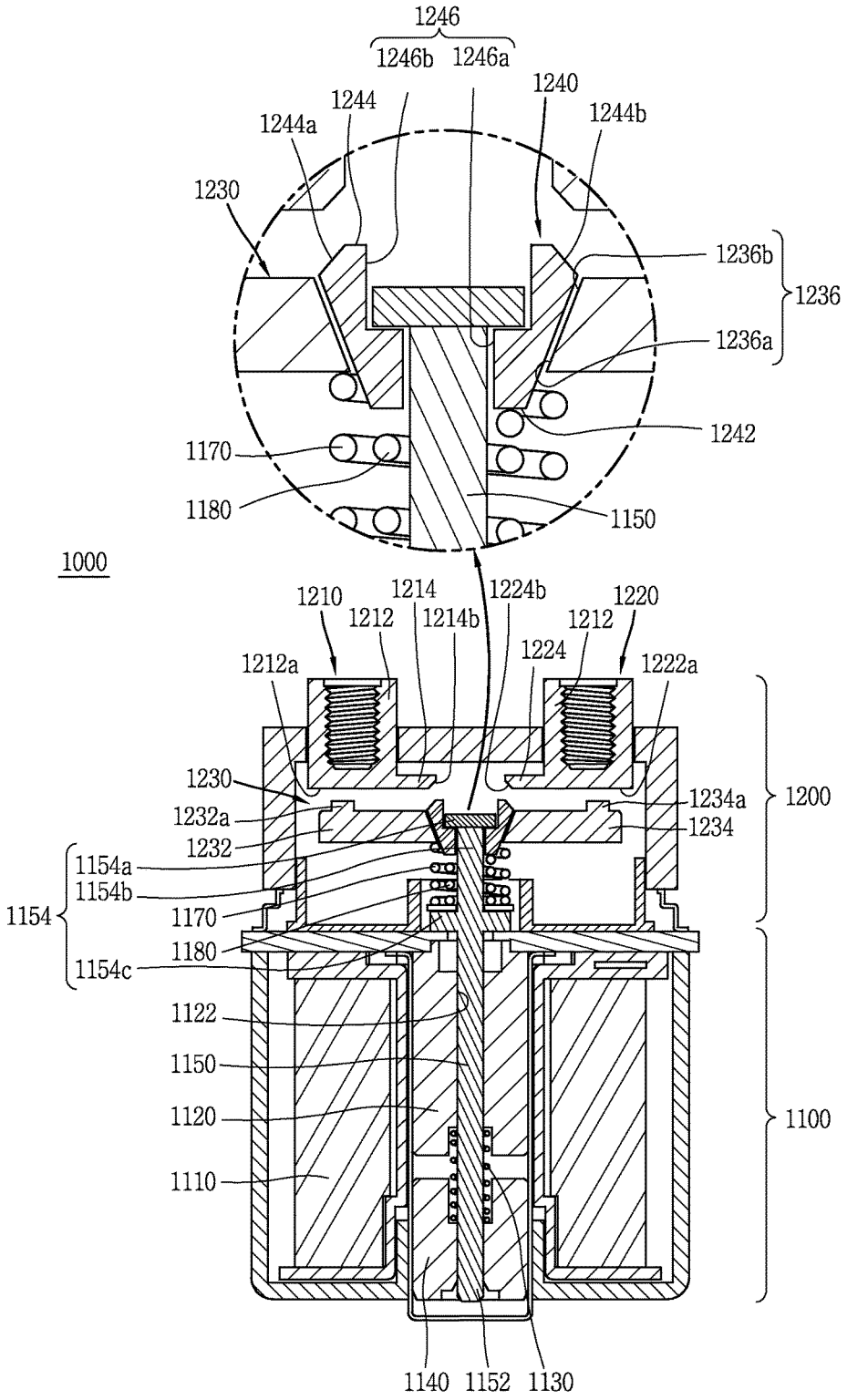
FIG. 2 is a cross-sectional view illustrating a relay according to an embodiment of the present invention.
Figure 3:
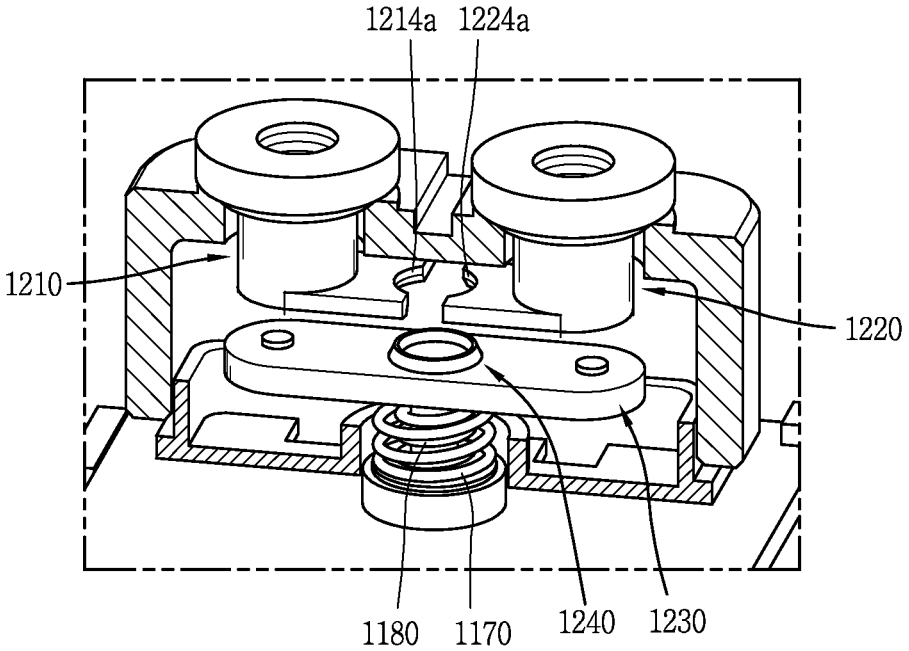
FIG. 3 is a perspective view illustrating a contact part of FIG. 2.
Figure 4:
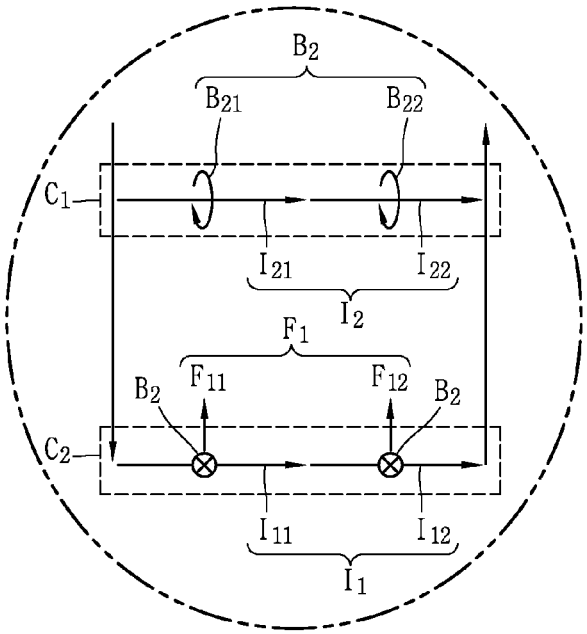
FIG. 4 is a cross-sectional view illustrating a state in which a moving contact of FIG. 2 contacts fixed contacts of FIG. 2.
Figure 4:
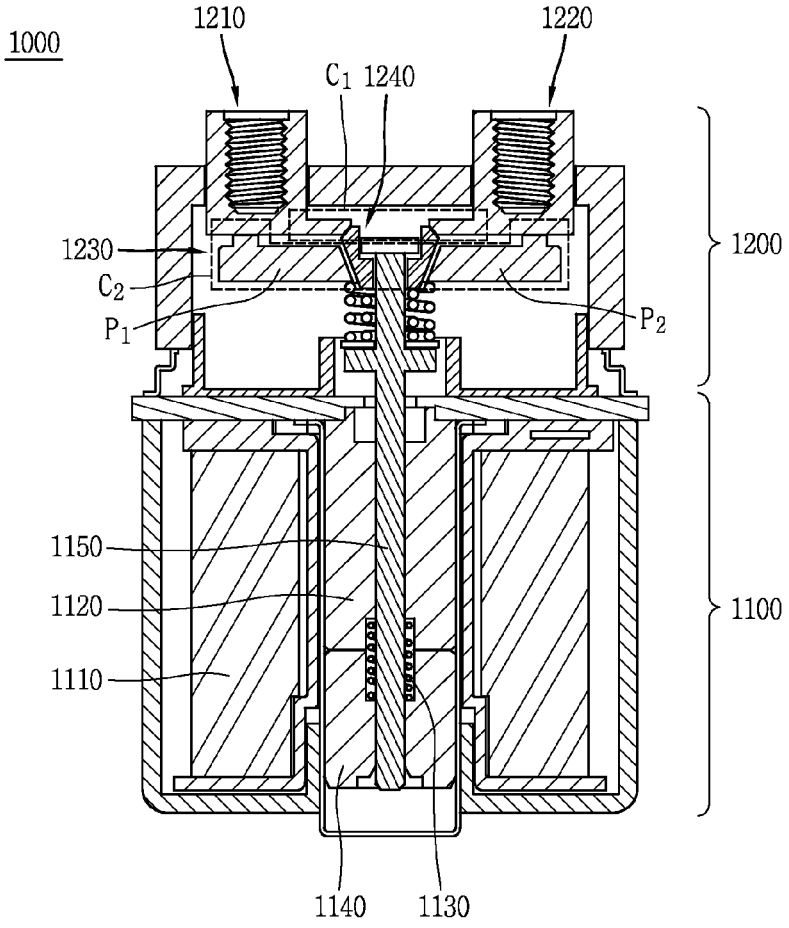

FIG. 2 is a cross-sectional view illustrating a relay 1000 according to an embodiment of the present invention. FIG. 3 is a perspective view illustrating a contact part of FIG. 2. FIG. 4 is a cross-sectional view illustrating a state in which a moving contact of FIG. 2 contacts fixed contacts of FIG. 2.

As illustrated in FIGS. 2 to 4, the relay 1000 according to an embodiment of the present invention includes a driver 1100, which generates a driving force, and a contact part 1200 that is driven by the driver 1100, and switches on or off a circuit. The contact part 1200 includes a first fixed contact 1210 that is connected to a power source, a second fixed contact 1220 that is separated from the first fixed contact 1210 and is connected to a load, and a plurality of moving contacts 1230 and 1240 that contact or are detached from the first fixed contact 1210 and the second fixed contact 1220 (hereinafter referred to as fixed contacts) by the driver 1100. The plurality of moving contacts 1230 and 1240 include a first moving contact 1230, which contacts or is detached from the fixed contacts 1210 and 1220, and a second moving contact 1230 that is separated from the first moving contact 1230, and contacts or is detached from the fixed contacts 1210 and 1220.

The driver 1100 may be configured with, for example, an actuator that generates a driving force with an electric force.

In more detail, the driver 1100 may be configured with a solenoid that includes a coil 1110 that generates a magnetic force with power applied thereto to form a magnetic field space, a fixed core 1120 that is fixedly disposed in the magnetic field space formed by the coil 1110, a movable core 1140 that is movably disposed in the magnetic field space so as to approach or be separated from the fixed core 1120, and a shaft 1150 that mechanically connects the movable core 1140 to the first moving contact 1230 and the second moving contact 1240.

Here, the movable core 1140, the fixed core 1120, the first moving contact 1230, the second moving contact 1240, and the fixed contacts 1210 and 1220 may be sequentially arranged. The shaft 1150 may extend from the movable core 1140 in a straight-line direction, and may be connected to the first moving contact 1230 and the second moving contact 1240 through the fixed core 1120.

A return spring 1130, which applies an elastic force in a direction where the movable core 1140 deviates from the fixed core 1120, may be provided between the fixed core 1120 and the movable core 1140.

One end 1152 of the shaft 1150 may be coupled to the movable core 1140, and the other end 1154 may be connected to the first moving contact 1230 and the second moving contact 1240 through the fixed core 1120.

In this case, a through hole 1122 may be formed at a center of the fixed core 1120 in order for the shaft 1150 to pass through the through hole 1122.

The shaft 1150, the first moving contact 1230, and the second movable fixed contact 1240 may be connected by a method where when the movable core 1140 moves to approach the fixed core 1120, the other end 1154 of the shaft 1150 pressurizes the first moving contact 1230 and the second moving contact 1240 toward the fixed contacts 1210 and 1220 through a plurality of contact springs 1170 and 1180 to be described below.

Moreover, the shaft 1150, the first moving contact 1230, and the second movable fixed contact 1240 may be connected by a method where when the movable core 1140 moves to be separated from the fixed core 1120, the other end 1154 of the shaft 1150 pressurizes the first moving contact 1230 and the second moving contact 1240 in a direction deviating from the fixed contacts 1210 and 1220 through a hanger 1154*a* which is provided at the other end 1154 of the shaft 1150.

In more detail, a connection structure between the shaft 1150, the first moving contact 1230, and the second movable fixed contact 1240 will be described below.

Before a description, some of details of the first moving contact 1230 and the second moving contact 1240 to be described below will be first described for describing the connection structure.

The first moving contact 1230 may be formed in a plate shape that extends in one axis direction.

A through hole 1236, through which the second moving contact 1240 passes, may be formed at a center of the first moving contact 1230.

The second moving contact 1240 may be formed to protrude from the first moving contact 1230 to a plurality of below-described arm parts 1216 and 1226 through the through hole 1236 of the first moving contact 1230.

Here, the second moving contact 1240 may be formed in a wedge shape where one end 1243 of the second moving contact 1240 is thinner than the other end 1244 of the second moving contact 1240.

The one end 1242 may be formed smaller than the through hole 1236 of the first moving contact 1230.

The other end 1244 may be formed greater than the through hole 1236 of the first moving contact 1230.

Moreover, the second moving contact 1240 may be disposed at a side opposite to the reverse of the movable core 1140 with respect to the through hole 1236 of the first moving contact 1230, and may be disposed on an axis which is formed by the through hole 1236 of the first moving contact 1230 and the shaft 1150.

Moreover, the second moving contact 1240 may be disposed so that the one end 1242 is toward the movable core 1140, and the other end 1244 is toward a direction deviating from the movable core 1140.

Therefore, when the second moving contact 1240 is moved to the movable core 1140, the second moving contact 1240 may be hanged on the through hole 1236 of the first moving contact 1230.

An inner circumference surface of the through hole 1236 of the first moving contact 1230 may be formed to be inclined with respect to a depth direction, and thus, a size of a second opening 1236*b* which is toward a direction deviating from the movable core 1140 may be formed greater than that of a first opening 1236*a* which is toward the movable core 1140.

Therefore, the inner circumference surface of the through hole 1236 of the first moving contact 1230 may contact an inclined surface which is formed by the one end 1242 and the other end 1244 of the second moving contact 1240.

A through hole 1246, through which the other end 1154 of the shaft 1150 passes from the one end 1242 to the other end 1244, may be formed at the second moving contact 1240.

An inner circumference surface of the through hole 1246 of the second moving contact 1240 may be formed to be stepped with respect to a depth direction, and thus, a size of a second opening 1246*b* which is toward a direction deviating from the movable core 1140 may be formed greater than that of a first opening 1246*a* which is toward the movable core 1140.

In this case, in the through hole 1246 of the second moving contact 1240, a size of the first opening 1246*a* may be formed smaller than the hanger 1154*a*, and a size of the second opening 1246*b* may be formed greater than the hanger 1154*a*.

Therefore, as described above, when the hanger 1154*a* is moved to the movable core 1140, the hanger 1154*a* may be hanged on the through hole 1246 of the second moving contact 1240.

As described above, in a state where the moving contacts 1230 and 1240 are formed and disposed, the shaft 1150 may be disposed so that the other end 1154 of the shat 1150 passes through the through hole 1236 of the first moving contact 1230 and the through hole 1246 of the second moving contact 1240.

The hanger 1154*a*, which protrudes in a radius direction from a portion opposite to the movable core 1140 with respect to the first opening 1246*a* of the through hole 1246 of the second moving contact 1240, may be provided at the other end 1154 of the shaft 1150.

The hanger 1154*a* may be formed greater than the first opening 1246*a* of the through hole 1246 of the second moving contact 1240 so that when the shaft 1150 is moved to the movable core 1140, the shaft 1150 does not pass through the through hole 1246 of the second moving contact 1240.

A spring supporting part 1154*c*, which protrudes in a radius direction from a portion which is disposed at the movable core 1140 side with respect to the first moving contact 1230 and the second moving contact 1240, may be provided at the other end 1154 of the shaft 1150.

A first contact spring 1170, of which one end is supported by the first moving contact 1230 and of which the other end is supported by the spring supporting part 1154*c*, may be provided between the first moving contact 1230 and the spring supporting part 1154*c*.

A second contact spring 1180, of which one end is supported by the second moving contact 1240 and of which the other end is supported by the spring supporting part 1154*c*, may be provided between the second moving contact 1240 and the spring supporting part 1154*c*.

The first contact spring 1170 and the second contact spring 1180 (hereinafter referred to as contact springs) may be, for example, coil springs.

In this case, a diameter of a coil part of the first contact spring 1170 may be formed greater than that of the through hole 1236 (in more detail, the first opening 1236*a*) of the first moving contact 1230.

A diameter of a coil part of the second contact spring 1180 may be formed smaller than that of the coil part of the first contact spring 1170 and greater than that of the through hole 1246 (in more detail, the first opening 1246*a*) of the first moving contact 1230.

A diameter of a portion 1154*b* of the shaft 1150, on which the contact springs 1170 and 1180 are mounted, may be formed greater than that of the coil part of the second contact spring 1180.

Therefore, the second contact spring 1180 may be provided between the second moving contact 1240 and the spring supporting part 1154*c* in a method where the shaft 1150 is inserted into the coil part of the second contact spring 1180.

Moreover, the first contact spring 1170 may be provided between the first moving contact 1230 and the spring supporting part 1154*c* in a method where the shaft 1150 and the second contact spring 1180 are inserted into the coil part of the first contact spring 1170.

Due to such a structure, the shaft 1150, the first moving contact 1230, and the second moving contact 1240 may be connected by a method in which when the movable core 1140 moves to approach the fixed core 1120, the other end 1154 of the shaft 1150 pressurizes the first moving contact 1230 and the second moving contact 1240 toward the fixed contacts 1210 and 1220 through the contact springs 1170 and 1180, and when the movable core 1140 moves to be separated from the fixed core 1120, the other end 1154 of the shaft 1150 pressurizes the first moving contact 1230 and the second moving contact 1240 in a direction deviating from the fixed contacts 1210 and 1220 through the hanger 1154*a*.

The contact part 1200, as described above, includes the first fixed contact 1210 that is connected to the power source, the second fixed contact 1220 that is separated from the first fixed contact 1210 and is connected to the load, and the plurality of moving contacts 1230 and 1240 that contact or are detached from the first fixed contact 1210 and the second fixed contact 1220 by the driver 1100. The plurality of moving contacts 1230 and 1240 include the first moving contact 1230, which contacts or is detached from the fixed contacts 1210 and 1220, and the second moving contact 1230 that is separated from the first moving contact 1230, and contacts or is detached from the fixed contacts 1210 and 1220.

In the contact part 1200, when the first moving contact 1230 and the second moving contact 1240 contact the fixed contacts 1210 and 1220, a Lorentz force F1 may be applied to the first moving contact 1230 by a current I1 passing through the first moving contact 1230 and a current I2 passing through the second moving contact 1240. The first moving contact 1230 may be moved in the same direction as a direction of the Lorentz force F1 applied to the first moving contact 1230, and may contact the fixed contacts 1210 and 1220.

To this end, the first fixed contact 1210 may include a first body part 1212, to which a current is applied, and a first arm part 1214 that protrudes from the first body part 1212 to the second fixed contact 1220.

The second fixed contact 1220 may include a second body part 1222, in which a current is applied to the load, and a second arm part 1224 that protrudes from the second body part 1222 to the first fixed contact 1210.

The first moving contact 1230 may contact the first body part 1212 and the second body part 1222 (hereinafter referred to as body parts) in a state where the first moving contact 1230 is separated from the first arm part 1214 and the second arm part 1224 (hereinafter referred to as arm parts) in a detachment direction of the first moving contact 1230.

Here, the detachment direction of the first moving contact 1230 denotes a direction in which the first moving contact 1230 is detached from the body parts 1212 and 1222.

The second moving contact 1240 may protrude from the first moving contact 1230 to the arm parts 1214 and 1224, and contact the arm parts 1214 and 1224.

In more detail, the first body part 1212 may be formed in a circular pillar shape.

Moreover, the first body part 1212 may be fixed to and supported by an external box.

In this case, one end 1212*a* of the first body part 1212 may be disposed in the external box, and the other end 1212*b* may protrude to the outside of the external box.

The one end 1212*a* of the first body part 1212 may contact a below-described first contact end portion 1232*a* of the first moving contact 1230.

The other end 1212*b* of the first body part 1212 may be connected to, for example, a power source such as a battery.

The first arm part 1214 may protrude from the one end 1212*a* of the first body part 1212.

In this case, when the first moving contact 1230 contacts the first body part 1212, the first arm part 1214 may be provided to be separated from the first moving contact 1230.

For reference, the first arm part 1214 may protrude from one side of the first body part 1212 which is farther away than the one end 1212*a* of the first body part 1212 with respect to the first moving contact 1230.

However, in this case, as described below, the first arm part 1214 becomes farther away from the first moving contact 1230, and thus, the Lorentz force F1 applied to the first moving contact 1230 is reduced. Therefore, a contacting force between the first moving contact 1230 and the first body part 1212 is reduced.

Therefore, according to the present embodiment, the first arm part 1214 may protrude from the one end 1212*a* of the first body part 1212 so as to decrease a gap between the first arm part 1214 and the first moving contact 1230.

The first arm part 1214 may be formed vertically to a moving axis of the first moving contact 1230 so that a current I21 passing through the first arm part 1214 flows vertically to the moving axis of the first moving contact 1230.

Moreover, the first arm part 1214 may be formed to extend in a straight-line direction so that the current I21 passing through the first arm part 1214 flows in a straight-line direction.

Moreover, the first arm part 1214 may be formed to extend in an axial direction crossing the body parts 1212 and 1222 so that a current I2 passing through the first arm part 1214 and the second arm part 1224 flows in a straight-line direction. At this time, the second arm part 1224 may be formed to extend in the axial direction crossing the body parts 1212 and 1222, and an extension axis of the first arm part 1214 may match an extension axis of the second arm part 1224.

Moreover, the first arm part 1214 may have a long protrusion length within a range which is allowed in a limit space, so that a length of a flow path of the current I21 passing through the first arm part 1214 becomes longer. Also, an end of the first arm part 1214 which is separated from the first body part 1212 may contact the second moving contact 1240.

A groove 1214*a* which is recessed toward the first body part 1212 may be formed at the end of the first arm part 1214 so as to correspond to a shape of the other end 1244 of the second moving contact 1240.

Moreover, the end of the first arm part 1214 may be chamfered so that a corner of the recessed groove 1214*a* opposite to the second moving contact 1240 has a first contact surface 1214*b* which is inclined in a moving direction of the second moving contact 1240.

The second body part 1222 may be formed in a circular pillar shape.

Moreover, the second body part 1222 may be separated from the first body part 1212, and may be fixed to and supported by the external box.

In this case, an axial direction of the second body part 1222 may be disposed in parallel with an axial direction of the first body part 1212.

Moreover, one end 1222*a* of the second body part 1222 may be disposed in the external box, and the other end 1222*b* may protrude to the outside of the external box.

The one end 1222*a* of the second body part 1222 may contact a below-described second contact end portion 1234*a* of the first moving contact 1230.

The other end 1222*b* of the second body part 1222 may be connected to the load so as to enable a current to flow.

The second arm part 1224 may protrude from the one end 1222*a* of the second body part 1222.

In this case, when the first moving contact 1230 contacts the second body part 1222, the second arm part 1224 may be provided to be separated from the first moving contact 1230.

For reference, the second arm part 1224 may protrude from one side of the second body part 1222 which is farther away than the one end 1222*a* of the second body part 1222 with respect to the first moving contact 1230.

However, in this case, as described below, the second arm part 1224 becomes farther away from the first moving contact 1230, and thus, the Lorentz force F1 applied to the first moving contact 1230 is reduced. Therefore, a contacting force between the first moving contact 1230 and the second body part 1222 is reduced.

Therefore, according to the present embodiment, the second arm part 1224 may protrude from the one end 1222*a* of the second body part 1222 so as to decrease a gap between the second arm part 1224 and the first moving contact 1230.

The second arm part 1224 may be formed vertically to the moving axis of the first moving contact 1230 so that a current I22 passing through the second arm part 1224 flows vertically to the moving axis of the first moving contact 1230.

Moreover, the second arm part 1224 may be formed to extend in a straight-line direction so that the current I22 passing through the second arm part 1224 flows in a straight-line direction.

Moreover, as described above, the second arm part 1224 may be formed to extend in the axial direction crossing the body parts 1212 and 1222 along with the first arm part 1214, so that the current I2 passing through the first arm part 1214 and the second arm part 1224 flows in a straight-line direction.

In this case, the extension axis of the first arm part 1214 may match the extension axis of the second arm part 1224.

Moreover, the second arm part 1224 may have a long protrusion length within a range which is allowed in a limit space, so that a length of a flow path of the current I22 passing through the second arm part 1224 becomes longer. Also, an end of the second arm part 1224 which is separated from the second body part 1222 may contact the second moving contact 1240.

A groove 1224*a* which is recessed toward the second body part 1222 may be formed at the end of the second arm part 1224 so as to correspond to a shape of the other end 1244 of the second moving contact 1240.

Moreover, the end of the first arm part 1214 may be chamfered so that a corner of the recessed groove 1224*a* opposite to the second moving contact 1240 has a second contact surface 1224*b* which is inclined in the moving direction of the second moving contact 1240.

The first moving contact 1230 may be formed in a plate shape which extends in an axial direction, so that the current I1 passing through the first moving contact 1230 flows in a straight-line direction.

An extension length of the first moving contact 1230 may be equal to or greater than a gap between the first body part 1212 and the second body part 1222.

A through hole 1236 may be formed at a center of the first moving contact 1230.

Moreover, the first contact end portion 1232*a* and the second contact end portion 1234*a* may be respectively provided at both ends 1232 and 1234 of the first moving contact 1230 in an extension direction of the first moving contact 1230 so that when the first moving contact 1230 contacts the body parts 1212 and 1222, the first moving contact 1230 is separated from the arm parts 1214 and 1224.

In more detail, the first moving contact 1230 may include the first contact end portion 1232*a* which protrudes from one end 1232 of the first moving contact 1230, which is opposite to the one end 1212*a* of the first body part 1212, to the one end 1212*a* of the first body part 1212 and contacts the one end 1212*a* of the first body part 1212.

Moreover, the first moving contact 1230 may include the second contact end portion 1234*a* which protrudes from the other end 1234 of the first moving contact 1230, which is opposite to the one end 1222*a* of the second body part 1222, to the one end 1222*a* of the second body part 1222 and contacts the one end 1222*a* of the second body part 1222.

In this case, the first contact end portion 1232*a* and the second contact end portion 1234*a* (hereinafter referred to as contact end portions) may be formed to contact the body parts 1212 and 1222 so as to prevent an arc from occurring.

Here, according to the present embodiment, the contact end portions 1232*a* and 1234*a* may be provided at the first moving contact 1230, but the present embodiment is not limited thereto.

Although not shown, for example, the first contact end portion 1232*a* may protrude from the one end 1212*a* of the first body part 1212, which is opposite to the one end 1232 of the first moving contact 1230, to the one end 1232 of the first moving contact 1230 and contact the one end 1232 of the first moving contact 1230.

In this case, the second contact end portion 1234*a* may protrude from the one end 1222*a* of the second body part 1222, which is opposite to the other end 1234 of the first moving contact 1230, to the other end 1234 of the first moving contact 1230 and contact the other end 1234 of the first moving contact 1230.

As another example, the first contact end portion 1232*a* may be provided at the one end 1232 of the first moving contact 1230 in the above-described method, and the second contact end portion 1234*a* may be provided at the one end 1222*a* of the second body part 1222 in the above-described method.

As another example, the first contact end portion 1232*a* may be provided at the one end 1212*a* of the first body part 1212 in the above-described method, and the second contact end portion 1234*a* may be provided at the other end 1234 of the first moving contact 1230 in the above-described method.

As another example, the first contact end portion 1232*a* and the second contact end portion 1234*a* may be provided as in the present embodiment, and additionally, a third contact end portion may protrude from the one end 1212*a* of the first body part 1212, which is opposite to the first contact end portion 1232*a*, to the first contact end portion 1232*a* and contact the first contact end portion 1232*a*.

In this case, a fourth contact end portion may protrude from the one end 1222*a* of the second body part 1222, which is opposite to the second contact end portion 1234*a*, to the second contact end portion 1234*a* and contact the second contact end portion 1234*a*.

In addition, the first moving contact 1230 and the body parts 1212 and 1222 may be provided in various methods so that when the first moving contact 1230 contacts the body parts 1212 and 1222, the first moving contact 1230 is separated from the arm parts 1214 and 1224. Additional descriptions on the various methods are not provided.

The first moving contact 1230 may be formed vertically to the moving axis of the first moving contact 1230 so that the current I1 passing through the first moving contact 1230 flows vertically to the moving axis of the first moving contact 1230.

Moreover, the first moving contact 1230 may be disposed in parallel with the arm parts 1214 and 1224 so that the current I1 passing through the first moving contact 1230 flows in parallel with the current I2 passing through the arm parts 1214 and 1224.

Moreover, the extension length of the first moving contact 1230 may be long formed within a range which is allowed in a limit space, so that a length of a flow path of the current I1 passing through the first moving contact 1230 becomes longer.

In this case, the first contact end portion 1232*a* may contact one side, which is farthest away from an end of the first arm part 1214, of the one end 1212*a* of the first body part 1212.

Moreover, the second contact end portion 1234*a* may contact one side, which is farthest away from an end of the second arm part 1224, of the one end 1222*a* of the second body part 1222.

Generally, a Lorentz force which is generated by two currents which flow separately from each other is inversely proportional to a gap between the two currents. That is, as the gap between the two currents becomes narrower, a magnitude of the Lorentz force increases.

Therefore, in order to increase a magnitude of the Lorentz force F1 which is applied to the first moving contact 1230 by the current I2 passing through the arm parts 1214 and 1224 and the current I1 passing through the first moving contact 1230, the first moving contact 1230 may be provided close to the first arm part 1214 and the second arm part 1224 within a range in which a current does not flow between the first moving contact 1230 and the first arm part 1214 and between the first moving contact 1230 and the second arm part 1224 when the first moving contact 1230 and the second moving contact 1240 contact the fixed contacts 1210 and 1220.

The second moving contact 1240, as described above, may be formed in a wedge shape. The second moving contact 1240 may be disposed at a side opposite to the movable core 1140. The second moving contact 1240 may protrude from the first moving contact 1230 to the arm parts 1214 and 1224, and contact the arm parts 1214 and 1224.

Here, when the first moving contact 1230 and the second moving contact 1240 contact the fixed contacts 1210 and 1220, the second moving contact 1240 may be separated from the first moving contact 1230, and may contact the arm parts 1214 and 1224. Therefore, the current I2 passing through the second moving contact 1240 may not flow to the first moving contact 1230.

The second moving contact 1240 may be formed as small as possible within a length range in which an end of the first arm part 1214 is connected to an end of the second arm part 1224 so as to enable a current to flow, so that a length of a flow path of a current passing through the arm parts 1214 and 1224 becomes longer, and may contact the end of the first arm part 1214 and the end of the second arm part 1224.

Moreover, the second moving contact 1240 may surface-contact the arm parts 1214 and 1224 so that an arc is prevented from occurring when the second moving contact 1240 contacts the arm parts 1214 and 1224.

According to the present embodiment, the second moving contact 1240 may be chamfered in order for a corner of the other end 1244 to be inclined with respect to the moving axis of the second moving contact 1240. Therefore, a third contact surface 1244*a* which is surface-contactable to be opposite to the first contact surface 1214*b* and a fourth contact surface 1244*b* which is surface-contactable to be opposite to the second contact surface 1224*b* may be provided at the other end 1244.

Here, the first moving contact 1230, the second moving contact 1240, and the fixed contacts 1210 and 1220 may be arranged to be symmetric with respect to one surface in which the shaft 1150 is provided.

Therefore, a contacting force between the first moving contact 1230 and the first fixed contact 1210 may be equal to or similar to a contacting force between the first moving contact 1230 and the second fixed contact 1220.

Moreover, a contacting force between the second moving contact 1240 and the first fixed contact 1210 may be equal to or similar to a contacting force between the second moving contact 1240 and the second fixed contact 1220.

Hereinafter, operational effects of the relay 1000 according to an embodiment of the present invention will be described.

When power is applied to the coil 1110, the coil 1110 may generate a magnetic force.

The movable core 1140 may be moved by the magnetic force in a direction (i.e., a direction (an up direction in the drawing) approaching the fixed core 1120) where a magnetic resistance is reduced.

In this case, the return spring 1130 may be charged between the fixed core 1120 and the movable core 1140.

The shaft 1150 may be moved, by a movement of the movable core 1140, in a direction (an up direction in the drawing) where the other end 1154 of the shaft 1150 deviates from the fixed core 1120.

The contact springs 1170 and 1180 may be charged between the moving contacts 1230 and 1240 and the spring supporting part 1154*c* by the movement of the shaft 1150.

In more detail, the first contact spring 1170 may be charged between the first moving contact 1230 and the spring supporting part 1154*c*, and the second contact spring 1180 may be charged between the second moving contact 1240 and the spring supporting part 1154*c*.

The first moving contact 1230 may be moved by the charging of the first contact spring 1170 in a direction (an up direction in the drawing) contacting the fixed contacts 1210 and 1220, and thus may contact the fixed contacts 1210 and 1220.

In more detail, the first contact end portion 1232*a* of the first moving contact 1230 may contact the one end 1212*a* of the first body part 1212, and the second contact end portion 1234*a* of the first moving contact 1230 may contact the one end 1222*a* of the second body part 1222.

When the first moving contact 1230 contacts the body parts 1212 and 1222, a first current flow path C1 may be formed by the first body part 1212, the first moving contact 1230, and the second body part 1222.

The second moving contact 1240 may be moved by the charging of the second contact spring 1180 in a direction (an up direction in the drawing) contacting the fixed contacts 1210 and 1220, and thus may be separated from the first moving contact 1230 and may contact the fixed contacts 1210 and 1220.

In more detail, the third contact surface 1244*a* of the second moving contact 1240 may contact the first contact surface 1214*b* of the first arm part 1214, and the fourth contact surface 1244*a* of the second moving contact 1240 may contact the second contact surface 1224*b* of the second arm part 1224.

When the second moving contact 1240 contacts the arm parts 1214 and 1224, a second current flow path C2 may be formed by the first body part 1212, the first arm part 1214, the second moving contact 1240, the second arm part 1224, and the second body part 1222.

When the first current flow path C1 and the second current flow path C2 are formed, a current supplied from the power source may flow to the load through the first current flow path C1 and the second current flow path C2.

Even after the first moving contact 1230 and the second moving contact 1240 contact the fixed contacts 1210 and 1220, the shaft 1150 may be continuously moved in a direction (an up direction in the drawing) where the other end 1154 of the shaft 1150 deviates from the fixed core 1120.

Therefore, the first moving contact 1230 and the second moving contact 1240 may be fixed to a position contacting the fixed contacts 1210 and 1220, or the spring supporting part 1154*c* may be continuously moved to the first moving contact 1230 and the second moving contact 1240.

Thus, the first contact spring 1170 and the second contact spring 1180 may be further charged, and may pressurize the first moving contact 1230 and the second moving contact 1240 to the fixed contacts 1210 and 1220 with higher force.

As a result, the first moving contact 1230 and the second moving contact 1240 may contact the fixed contacts 1210 and 1220 with a certain contacting force, and thus, a contact state between the first moving contact 1230, the second moving contact 1240, and the fixed contacts 1210 and 1220 can be stably maintained.

On the other hand, when the supply of power to the coil 1110 is stopped, the generation of a magnetic force by the coil 1110 may be stopped.

When the generation of a magnetic force by the coil 1110 is stopped, the movable core 1140 may be moved by an elastic force of each of the contact springs 1170 and 1180 and the return spring 1130 in a direction (a down direction in the drawing) deviating from the fixed core 1120.

In this process, the return spring 1130 may be discharged between the fixed core 1120 and the movable core 1140.

The shaft 1150 may be moved by a movement of the movable core 1140 in a direction (a down direction in the drawing) where the other end 1154 of the shaft 1150 becomes closer to the fixed core 1120.

At this time, the shaft 1150 may be hanged on the second moving contact 1240 without the hanger 1154*a* passing through the through hole 1246 of the second moving contact 1240.

The second moving contact 1240 may be moved by the shaft 1150 in a direction (a down direction in the drawing) deviating from the fixed contacts 1210 and 1220 in a state where the hanger 1154*a* is hanged on the second moving contact 1240, and thus may be detached from the fixed contacts 1210 and 1220.

Moreover, the second moving contact 1240 may be hanged on the first moving contact 1230 without the other end 1244 passing through the through hole 1236 of the first moving contact 1230.

The first moving contact 1230 may be moved by the second moving contact 1240 in a direction (a down direction in the drawing) deviating from the fixed contacts 1210 and 1220 in a state where the other end 1244 is hanged on the first moving contact 1230, and thus may be detached from the fixed contacts 1210 and 1220.

In this process, the first contact spring 1170 and the second contact spring 1180 may be discharged between the moving contacts 1230 and 1240 and the spring supporting part 1154*c*.

When the first moving contact 1230 and the second moving contact 1240 are detached from the fixed contacts 1210 and 1220, a circuit may be broken. That is, power which is supplied from the power source to the load through the first moving contact 1210, the first moving contact 1230, the second moving contact 1240, and the second moving contact 1220 may be cut off.

Here, in the relay 1000 according to an embodiment of the present invention, a current may flow through the first current flow path C1 and the second current flow path C2.

Therefore, a level of a current flowing through one flow current path may be lowered.

When the level of the current is lowered, the inter-electron repulsion proportional to the square of the level of the current may be more reduced than a degree to which the level of the current is lowered.

As a result, the first moving contact 1230 and the second moving contact 1240 are prevented from being detached from the fixed contacts 1210 and 1220 by the inter-electron repulsion.

In the relay 1000 according to an embodiment of the present invention, a magnetic field B2 may be generated by the current I2 which flows in the second current flow path C2.

The magnetic field B2 generated by the current I2 which flows in the second current flow path C2, as illustrated in FIG. 4, may act in a direction entering the first current flow path C1.

In the current I1 which flows from the first body part 1212 to the second body part 1222 (from a left side to a right side in the drawing) through the first current flow path C1, the Lorentz force F1 may be generated by the magnetic field B2. A direction of the Lorentz force F1 may be a direction (an up direction in the drawing) of Lorentz force based on Lorentz's left hand rule.

In more detail, a magnetic field B21 generated by the current I21 which flows in the first arm part 1214 may act in a direction entering a first pressurizing part P1 of the first moving contact 1230. Here, the first pressurizing part P1 is an extension part between the first contact end portion 1232*a* of the first moving contact 1230 and the through hole 1236 of the first moving contact 1230, and denotes a part opposite to the first arm part 1214.

In a current I11 which flows from the first contact end portion 1232*a* to the through hole 1236 of the first moving contact 1230 (from a left side to a right side in the drawing) in the first pressurizing part P1, a Lorentz force may be generated by a magnetic field B21 generated by the current I21 which flows in the first arm part 1214. A direction of the Lorentz force may be a direction (an up direction in the drawing) of Lorentz force based on Lorentz's left hand rule.

Moreover, a magnetic field B22 generated by the current I22 which flows in the second arm part 1224 may act in a direction entering a second pressurizing part P2 of the first moving contact 1230. Here, the second pressurizing part P2 is an extension part between the second contact end portion 1234*a* of the first moving contact 1230 and the through hole 1236 of the first moving contact 1230, and denotes a part opposite to the second arm part 1224.

In a current I12 which flows from the through hole 1236 of the first moving contact 1230 to the second contact end portion 1234*a* (from a left side to a right side in the drawing) in the second pressurizing part P2, a Lorentz force may be generated by a magnetic field B22 generated by the current I22 which flows in the second arm part 1224. A direction of the Lorentz force may be a direction (an up direction in the drawing) of Lorentz force based on Lorentz's left hand rule.

The first moving contact 1230 may be moved in a direction of the Lorentz force F1 which acts on the first pressurizing part P1 and the second pressurizing part P2, and may contact the body parts 1212 and 1222. Therefore, a contacting force between the first moving contact 1230 and the fixed contacts 1210 and 1220 further increases due to the Lorentz force F1.

Accordingly, the first moving contact 1230 can be prevented from being detached from the fixed contacts 1210 and 1220 by the inter-electron repulsion.

In the relay 1000 according to an embodiment of the present invention, even without increasing the pickup voltage of the driver 1100 which drives the first moving contact 1230 and the second moving contact 1240, the first moving contact 1230 and the second moving contact 1240 can be prevented from being detached from the fixed contacts 1210 and 1220 by the inter-electron repulsion.

Therefore, electric energy used to drive the driver 1100 can be saved compared to when the driver 1100 is driven by increasing the pickup voltage.

In the relay 1000 according to an embodiment of the present invention, a current may flow in a straight-line direction in the first current flow path C1 which is formed as long as possible in a limit space.

Moreover, a current may flow in a straight-line direction in the second current flow path C2 which is formed as long as possible in the limit space.

Moreover, the current I1 flowing in the first current flow path C1 and the current I2 flowing in the second current flow path C2 may flow in parallel in the same direction.

Moreover, the current I1 flowing in the first current flow path C1 and the current I2 flowing in the second current flow path C2 may flow in a direction vertical to the moving axis of the first moving contact 1230.

At this time, the current I1 flowing in the first current flow path C1 may be disposed to be separated from the current I2, flowing in the second current flow path C2, in a direction where the first moving contact 1230 is detached from the body parts 1212 and 1222.

Therefore, a magnitude of the Lorentz force used to increase a contacting force between the first moving contact 1230 and the fixed contacts 1210 and 1220 can further increase.

This will now be described in more detail.

In the first moving contact 1230, the second moving contact 1240, and the fixed contacts 1210 and 1220, lengths of the first current flow path C1 and the second current flow path C2 may be formed as long as possible in the limit space.

Therefore, a part in which the Lorentz force F1 is generated is enlarged, and thus, the magnitude of the Lorentz force F1 applied to the first moving contact 1230 can further increase.

The first moving contact 1230, the second moving contact 1240, and the fixed contacts 1210 and 1220 may be provided so that the current I1 flowing in the first current flow path C1 flows in a straight-line direction.

Moreover, the first moving contact 1230, the second moving contact 1240, and the fixed contacts 1210 and 1220 may be provided so that the current I2 flowing in the second current flow path C2 flows in a straight-line direction.

Therefore, the magnetic field B21 generated by the current I21 which flows in the first arm part 1214 may act on the first pressurizing part P1 in the same direction as that of the magnetic field B22 generated by the current I22 which flows in the second arm part 1224.

In other words, in addition to the magnetic field B21 generated by the current I21 which flows in the first arm part 1214, the magnetic field B22 generated by the current I22 which flows in the second arm part 1224 may act on the first pressurizing part P1. A direction of the magnetic field B21 acting on the first pressurizing part P1 may match a direction of magnetic field B22 acting on the first pressurizing part P1.

Therefore, two the magnetic fields B21 and B22 may act on the first pressurizing part P1 without being counteracted. Also, since the two magnetic fields B21 and B22 are summated, the magnitude of the magnetic field B2 acting on the first pressurizing part P1 increases.

As a result, the magnitude of the Lorentz force F1 acting on the first pressurizing part P1 can further increase.

With the same principle, the magnetic field B22 generated by the current I22 which flows in the second arm part 1224 may act on the second pressurizing part P2 in the same direction as that of the magnetic field B21 generated by the current I21 which flows in the first arm part 1214.

In other words, in addition to the magnetic field B22 generated by the current I22 which flows in the second arm part 1224, the magnetic field B21 generated by the current I21 which flows in the first arm part 1214 may act on the second pressurizing part P2. A direction of the magnetic field B21 acting on the second pressurizing part P2 may match a direction of magnetic field B22 acting on the second pressurizing part P2.

Therefore, the two magnetic fields B21 and B22 may act on the second pressurizing part P2 without being counteracted. Also, since the two magnetic fields B21 and B22 are summated, the magnitude of the magnetic field B2 acting on the second pressurizing part P2 increases.

As a result, the magnitude of the Lorentz force F1 acting on the second pressurizing part P2 can further increase.

Hereinabove, that the magnitude of the Lorentz force F1 increases has been described with a relationship between the magnetic field B21 (generated by the current I21 which flows in the first arm part 1214) and the magnetic field B22 (generated by the current I22 which flows in the second arm part 1224) as an example. However, this principle may be applied in the magnetic field B21, generated by the current I21 which flows in the first arm part 1214, and the magnetic field B22 generated by the current I22 which flows in the second arm part 1224.

For example, in the magnetic field B21 generated by the current I21 which flows in the first arm part 1214, a magnetic field B211 generated by a current I211 which flows in one side of the first arm part 1214 may act on the first pressurizing part P1 in the same direction as that of a magnetic field B212 generated by a current I212 which flows in the other side of the first arm part 1214.

In other words, in addition to the magnetic field B211 generated by a current I211 which flows in one side of the first arm part 1214, the magnetic field B212 generated by a current I212 which flows in the other side of the first arm part 1214 may act on the first pressurizing part P1. A direction of the magnetic field B211 acting on the first pressurizing part P1 may match a direction of magnetic field B212 acting on the first pressurizing part P1.

Therefore, two the magnetic fields B211 and B212 may act on the first pressurizing part P1 without being counteracted. Also, since the two magnetic fields B211 and B212 are summated, the magnitude of the magnetic field B2 acting on the first pressurizing part P1 increases.

As a result, the magnitude of the Lorentz force F1 acting on the first pressurizing part P1 can further increase.

The first moving contact 1230, the second moving contact 1240, and the fixed contacts 1210 and 1220 may be provided so that the current I2 flowing in the second current flow path C2 flows in a direction vertical to the moving axis of the first moving contact 1230.

Moreover, the first moving contact 1230, the second moving contact 1240, and the fixed contacts 1210 and 1220 may be provided so that the current I1 flowing in the first current flow path C1 flows in the direction vertical to the moving axis of the first moving contact 1230.

Moreover, the first moving contact 1230, the second moving contact 1240, and the fixed contacts 1210 and 1220 may be provided so that the current I1 flowing in the first current flow path C1 and the current I2 flowing in the second current flow path C2 flow in parallel in the same direction.

Moreover, the first moving contact 1230, the second moving contact 1240, and the fixed contacts 1210 and 1220 may be provided so that the current I1 flowing in the first current flow path C1 flows at a separated position in a direction, where the first moving contact 1230 is detached from the body parts 1212 and 1222, with respect to the current I2 flowing in the second current flow path C2.

Therefore, an intensity of the magnetic field B2 acting on the first moving contact 1230 may be uniform and high in an entire portion of the first moving contact 1230.

Moreover, a direction of the magnetic field B2 acting on the first moving contact 1230 may be vertical to a direction of the current I1 passing through the first moving contact 1230.

Moreover, a contact direction of the first moving contact 1230 may match a direction of the Lorentz force F1 which is vertical to the direction of the magnetic field B2 acting on the first moving contact 1230 and the direction of the current I1 passing through the first moving contact 1230.

Therefore, the Lorentz force F1 which is generated by the magnetic field B2 acting on the first moving contact 1230 and the current I1 flowing in the first moving contact 1230 is maximized, and the maximized Lorentz force F1 is used to increase a contacting force between the first moving contact 1230 and the fixed contacts 1210 and 1220.

Figure 5:
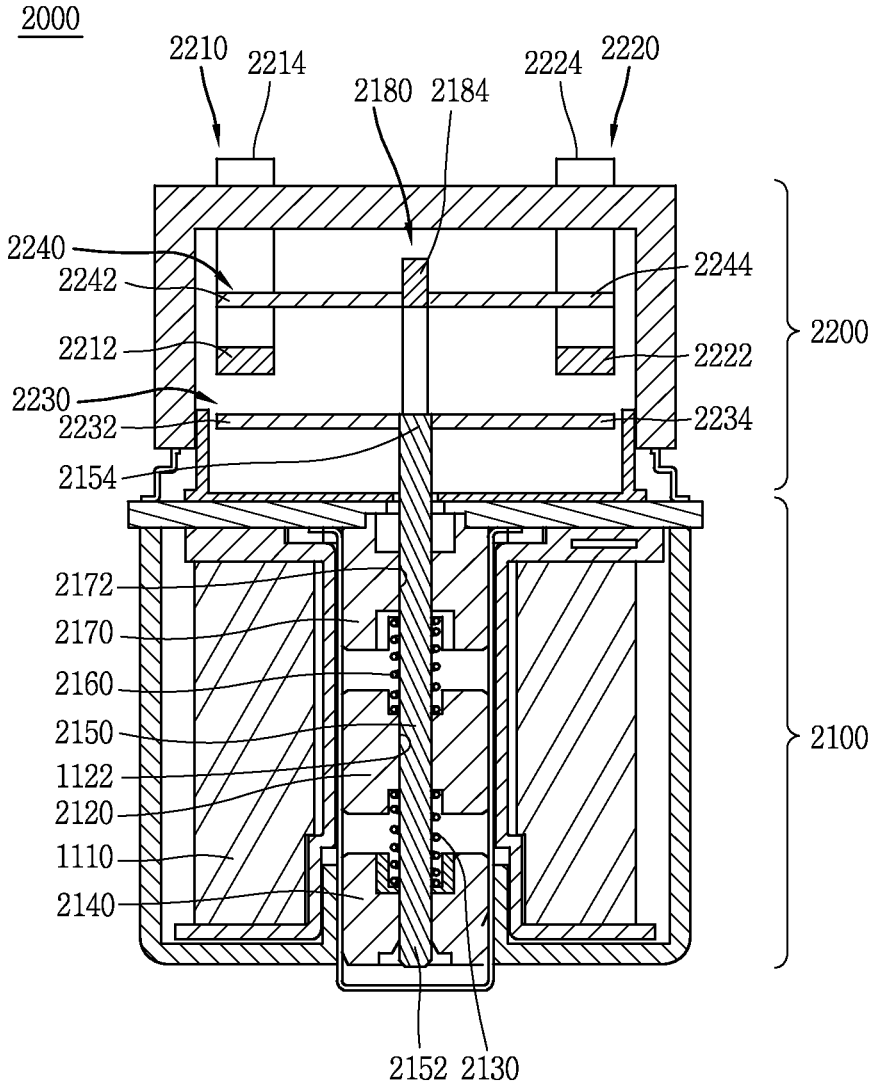
FIG. 5 is a cross-sectional view illustrating a relay according to another embodiment of the present invention.
Figure 6:
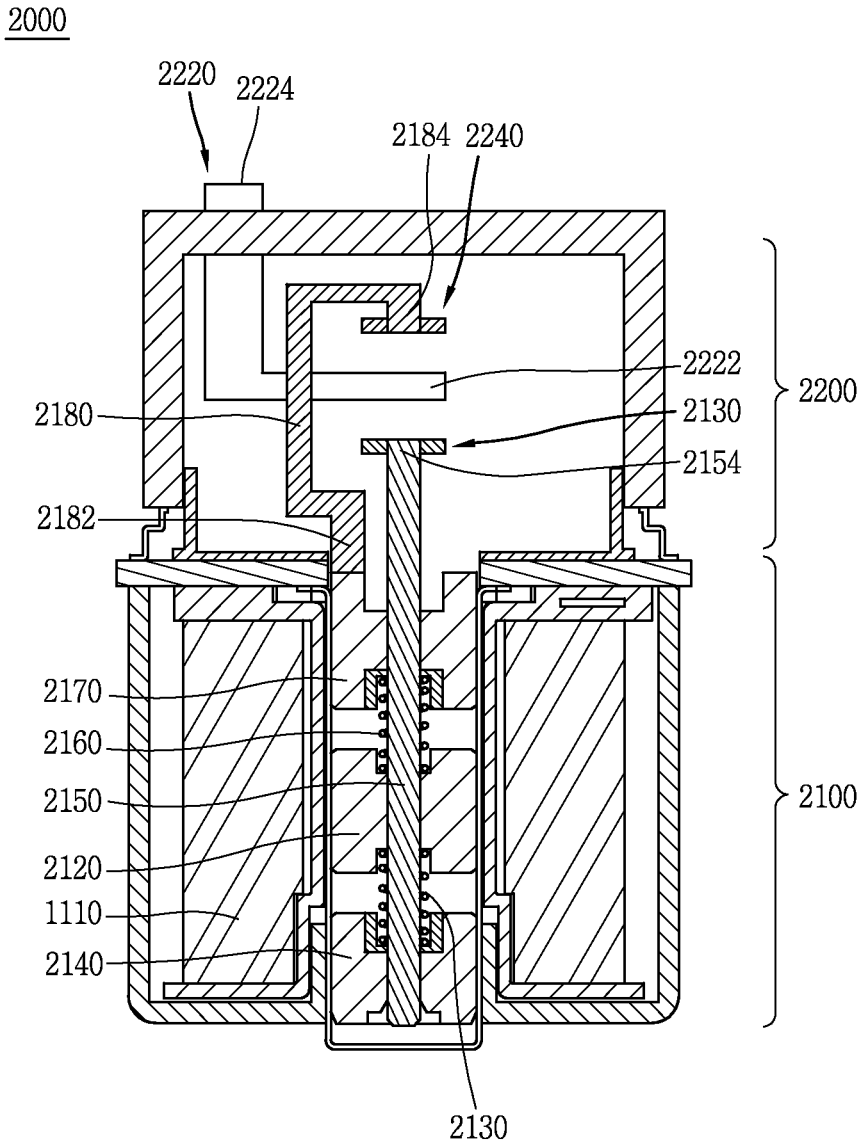
FIG. 6 is a cross-sectional view when
Figure 7:
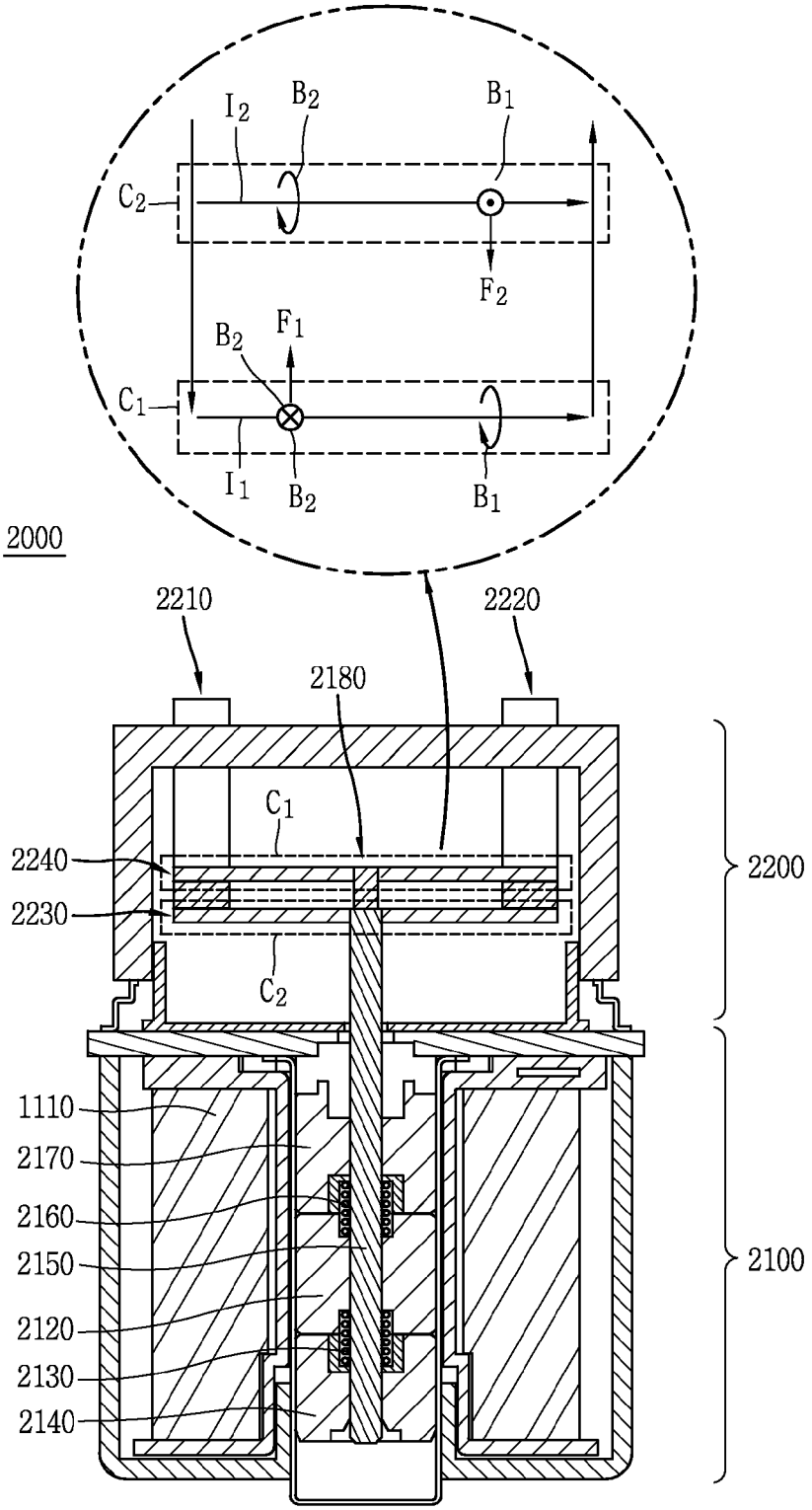
FIG. 7 is a cross-sectional view illustrating a state in which a moving contact of FIG. 5 contacts fixed contacts of FIG. 5.

FIG. 5 is a cross-sectional view illustrating a relay 2000 according to another embodiment of the present invention. FIG. 6 is a cross-sectional view when FIG. 5 is seen from a side. FIG. 7 is a cross-sectional view illustrating a state in which a moving contact of FIG. 5 contacts fixed contacts of FIG. 5.

Hereinafter, the relay 2000 according to another embodiment of the present invention will be described with reference to FIGS. 5 to 7.

For convenience of description, like reference numerals refer to like elements, and descriptions on the same elements are not repeated.

As illustrated in FIGS. 5 to 7, the relay 2000 according to an embodiment of the present invention includes a driver 2100, which generates a driving force, and a contact part 2200 that is driven by the driver 2100, and switches on or off a circuit. The contact part 2200 includes a first fixed contact 2210 that is connected to a power source, a second fixed contact 2220 that is separated from the first fixed contact 2210 and is connected to a load, and a plurality of moving contacts 2230 and 2240 that contact or are detached from the first fixed contact 2210 and the second fixed contact 2220 (hereinafter referred to as fixed contacts) by the driver 2100. The plurality of moving contacts 2230 and 2240 include a first moving contact 2230, which contacts or is detached from the fixed contacts 2210 and 2220, and a second moving contact 2230 that is separated from the first moving contact 2230, and contacts or is detached from the fixed contacts 2210 and 2220.

The driver 2100 may be configured with, for example, an actuator that generates a driving force with an electric force.

In more detail, the driver 2100 may be configured with a solenoid that includes a coil 2110 that generates a magnetic force with power applied thereto to form a magnetic field space, a fixed core 2120 that is fixedly disposed in the magnetic field space formed by the coil 2110, a first movable core 2140 that is movably disposed in the magnetic field space so as to approach or be separated from the fixed core 1120, a second movable core 2170 that is disposed in the magnetic field space so as to approach or be separated from the fixed core 2120 at a side opposite to the first movable core 2140 with respect to the fixed core 2120, a first shaft 2150 that mechanically connects the first movable core 2140 to the first moving contact 2230, and a second shaft 2180 that mechanically connects the second movable core 2170 to the second moving contact 2240.

Here, the first movable core 2140, the fixed core 2120, the second movable core 2170, the first moving contact 2230, the fixed contacts 2210 and 2220, and the second moving contact 2240 may be sequentially arranged.

In this case, the first shaft 2150 may extend from the first movable core 2140 in a straight-line direction, and may be connected to the first moving contact 2230 through the fixed core 1120 and the second movable core 2170.

The second shaft 2180*b* may extend from the second movable core 2170. In detail, the second shaft 2180*b* may be bent without interfering in the first shaft 2150 and the first moving contact 2230, and may be connected to the second moving contact 2240.

A first return spring 2130, which applies an elastic force in a direction where the first movable core 2140 deviates from the fixed core 2120, may be provided between the fixed core 2120 and the first movable core 2140.

A second return spring 2160, which applies an elastic force in a direction where the second movable core 2170 deviates from the fixed core 2120, may be provided between the fixed core 2120 and the second movable core 2170.

One end 2152 of the first shaft 2150 may be coupled to the first movable core 2140, and the other end 2154 may be connected to the first moving contact 2230 through the fixed core 2120 and the second movable core 2170.

In this case, a plurality of through holes 2122 and 2172 may be formed at a center of the fixed core 2120 and a center of the second movable core 2170 in order for the shaft 2150 to pass through the through holes 2122 and 2172.

One end 2152 of the first shaft 2150 may be coupled to the first movable core 2140, and the other end 2154 may be connected to the first moving contact 2230 through the fixed core 2120 and the second movable core 2170.

Here, a connection structure of the first shaft 2150 and the first moving contact 2230 and a connection structure of the second shaft 2180 and the second moving contact 2240 may be configured with a contact spring and a hanger in the same method as the method according to the above-described embodiment. The connection structures are not main elements, and thus will be briefly described.

That is, in the present embodiment, the first shaft 2150 and the first moving contact 2230 may be fixedly connected to each other by a coupling means such as welding, and the second shaft 2180 and the second moving contact 2240 may be fixedly connected to each other by a coupling means such as welding.

The contact part 2200, as described above, includes the first fixed contact 2210 that is connected to the power source, the second fixed contact 2220 that is separated from the first fixed contact 2210 and is connected to the load, and the plurality of moving contacts 2230 and 2240 that contact or are detached from the first fixed contact 2210 and the second fixed contact 2220 by the driver 2100. The plurality of moving contacts 2230 and 2240 include the first moving contact 2230, which contacts or is detached from the fixed contacts 2210 and 2220, and the second moving contact 2230 that is separated from the first moving contact 2230, and contacts or is detached from the fixed contacts 2210 and 2220.

In the contact part 2200, when the first moving contact 2230 and the second moving contact 2240 contact the fixed contacts 2210 and 2220, a Lorentz force F1 may be applied to the first moving contact 2230 by a current I1 passing through the first moving contact 2230 and a current I2 passing through the second moving contact 2240. The first moving contact 2230 may be moved in the same direction as a direction of the Lorentz force F1 applied to the first moving contact 2230, and may contact the fixed contacts 2210 and 2220.

In the contact part 2200, when the first moving contact 2230 and the second moving contact 2240 contact the fixed contacts 2210 and 2220, a Lorentz force F2 may be applied to the second moving contact 2240 by a current I1 passing through the first moving contact 2230 and a current I2 passing through the second moving contact 2240. The second moving contact 2240 may be moved in the same direction as a direction of the Lorentz force F2 applied to the second moving contact 2240, and may contact the fixed contacts 2210 and 2220.

In more detail, the first fixed contact 2210 may be fixed to and supported by an external box.

Moreover, one end 2212 of the first fixed contact 2210 may be disposed in the external box, and the other end 2214 may protrude to the outside of the external box.

The one end 2212 of the first fixed contact 2210 may contact the first moving contact 2230 at one side of the one end 2212, and may contact the second moving contact 2240 at other side.

The other end 2214 of the first fixed contact 2210 may be connected to, for example, a power source such as a battery so as to a current to flow.

The second fixed contact 2220 may be separated from the first fixed contact 2210, and may be fixed to and supported by the external box.

Moreover, one end 2222 of the second fixed contact 2220 may be disposed in the external box, and the other end 2224 may protrude to the outside of the external box.

The one end 2222 of the second fixed contact 2220 may contact the first moving contact 2230 at one side of the one end 2222, and may contact the second moving contact 2240 at other side.

The other end 2224 of the second fixed contact 2220 may be connected to a load so as to a current to flow.

The first moving contact 2230 may be formed in a plate shape having a length equal to or greater than a gap between the fixed contacts 2210 and 2220 so as to contact the fixed contacts 2210 and 2220.

In this case, the first moving contact 2230 may extend in a straight-line direction so that the current I1 passing through the first moving contact 2230 flows in a straight-line direction.

Moreover, the first moving contact 2230 may be formed vertically to a moving axis of the first moving contact 2230 so that the current I1 passing through the first moving contact 2230 flows in a direction vertical to the moving axis of the first moving contact 2230.

The second moving contact 2240 may be formed in a plate shape having a length equal to or greater than a gap between the fixed contacts 2210 and 2220 so as to contact the fixed contacts 2210 and 2220.

In this case, the second moving contact 2240 may extend in a straight-line direction so that the current I2 passing through the second moving contact 2240 flows in a straight-line direction.

Moreover, the second moving contact 2240 may be formed vertically to a moving axis of the second moving contact 2240 so that the current I2 passing through the second moving contact 2240 flows in a direction vertical to the moving axis of the second moving contact 2240.

The first moving contact 2230, the second moving contact 2240, and the fixed contacts 2210 and 2220 may be provided so that the first moving contact 2230 is moved in one direction, and contact one side of the one end 2212 of the first fixed contact 2210 and one side of the one end 2222 of the second fixed contact 2220.

Moreover, the first moving contact 2230, the second moving contact 2240, and the fixed contacts 2210 and 2220 may be provided so that the second moving contact 2240 is moved in a direction opposite to the one direction, and contact the other side of the one end 2212 of the first fixed contact 2210 and the other side of the one end 2222 of the second fixed contact 2220.

Here, the first moving contact 2230 and the second moving contact 2240 may be disposed in parallel so that the current I1 flowing in the first moving contact 2230 and the current I2 flowing in the second moving contact 2240 flow in parallel in the same direction.

Moreover, as described below, a moving axis of the first moving contact 2230 and a moving axis of the second moving contact 2240 may be disposed on the same axis so as to maximize the Lorentz force F1 acting on the first moving contact 2230 and the Lorentz force F2 acting on the second moving contact 2240.

In order to increase a magnitude of the Lorentz force F1 acting on the first moving contact 2230 and a magnitude of the Lorentz force F2 acting on the second moving contact 2240, the first moving contact 2230 and the second moving contact 2240 may be provided close to each other within a range in which a current does not flow between the first moving contact 2230 and the second moving contact 2240 when the first moving contact 2230 and the second moving contact 2240 contact the fixed contacts 2210 and 2220.

To this end, a thickness of the one end 2212 of the first fixed contact 2210 and a thickness of the one end 2222 of the second fixed contact 22220 may be formed as thin as possible within a range in which a current does not flow between the first moving contact 2230 and the second moving contact 2240.

Here, the thickness of the one end 2212 of the first fixed contact 2210 denotes a distance between one side of the one end 2212 of the first fixed contact 2210 and the other side, contacting the second moving contact 2240, of the one end 2212 of the first fixed contact 2210.

Moreover, the thickness of the one end 2222 of the second fixed contact 2220 denotes a distance between one side of the one end 2222 of the second fixed contact 2220 and the other side, contacting the second moving contact 2240, of the one end 2222 of the second fixed contact 2220.

In the first moving contact 2230, the second moving contact 2240, and the fixed contacts 2210 and 2220, a flow path of the current I1 flowing in the first moving contact 2230 and a flow path of the current I2 flowing in the second moving contact 2240 may be formed to be longer within a range which is allowed in a limit space.

That is, the first moving contact 2230 and the second moving contact 2240 may be long formed within a range which is allowed in the limit space. The first fixed contact 2210 may contact one end 2232 of the first moving contact 2230 and one end 2242 of the second moving contact 2240, and the second fixed contact 2220 may contact the other end 2234 of the first moving contact 2230 and the other end 2244 of the second moving contact 2240.

The first moving contact 2230, the second moving contact 2240, and the fixed contacts 2210 and 2220 may be provided so that the first moving contact 2230 surface-contacts the fixed contacts 2210 and 2220, and the second moving contact 2240 surface-contacts the fixed contacts 2210 and 2220, so as to prevent an arc from occurring.

The first moving contact 2230, the second moving contact 2240, and the fixed contacts 2210 and 2220 may be provided to be symmetric with respect to one surface in which the first shaft 2150 and the second shaft 2180 are provided.

Therefore, a contacting force between the first moving contact 2230 and the first fixed contact 2210 is equal to or similar to a contacting force between the first moving contact 2230 and the second fixed contact 2220.

Moreover, a contacting force between the second moving contact 2240 and the first fixed contact 2210 is equal to or similar to a contacting force between the second moving contact 2240 and the second fixed contact 2220.

Hereinafter, operational effects of the relay 2000 according to an embodiment of the present invention will be described.

When power is applied to the coil 2110, the coil 2110 may generate a magnetic force.

The first movable core 2140 may be moved by the magnetic force in a direction (i.e., a direction (an up direction in the drawing) approaching the fixed core 2120) where a magnetic resistance is reduced.

In this case, the first return spring 2130 may be charged between the fixed core 2120 and the first movable core 2140.

The first shaft 2150 may be moved, by a movement of the first movable core 2140, in a direction (an up direction in the drawing) where the other end 2154 of the first shaft 2150 deviates from the fixed core 2120.

The first moving contact 2230 may be moved by the movement of the first shaft 2150 in a direction (an up direction in the drawing) contacting the fixed contacts 2210 and 2220, and thus may contact the fixed contacts 2210 and 2220.

In more detail, the one end 2232 of the first moving contact 2230 may contact one side of the one end 2212 of the first fixed contact 2210, and the other end 2234 of the first moving contact 2230 may contact one side of the one end 2222 of the second fixed contact 2220.

When the first moving contact 2230 contacts the fixed contacts 2210 and 2220, a first current flow path C1 may be formed by the first fixed contact 2210, the first moving contact 2230, and the second fixed contact 2220.

The second movable core 2170 may be moved by the magnetic force in a direction (i.e., a direction (a down direction in the drawing) approaching the fixed core 2120) where a magnetic resistance is reduced.

In this case, the second return spring 2160 may be charged between the fixed core 2120 and the second movable core 2170.

The second shaft 2180 may be moved, by a movement of the second movable core 2170, in a direction (a down direction in the drawing) where the other end 2184 of the second shaft 2180 deviates from the fixed core 2120.

The second moving contact 2240 may be moved by the movement of the second shaft 2150 in a direction (an up direction in the drawing) contacting the fixed contacts 2210 and 2220, and thus may contact the fixed contacts 2210 and 2220 to be separated from the first moving contact 2230.

In more detail, the one end 2242 of the second moving contact 2240 may contact the other side of the one end 2212 of the first fixed contact 2210, and the other end 2244 of the second moving contact 2240 may contact the other side of the one end 2222 of the second fixed contact 2220.

When the second moving contact 2240 contacts the fixed contacts 2210 and 2220, a second current flow path C1 may be formed by the first fixed contact 2210, the second moving contact 2240, and the second fixed contact 2220.

When the first current flow path C1 and the second current flow path C2 are formed, a current supplied from the power source may flow to the load through the first current flow path C1 and the second current flow path C2.

On the other hand, when the supply of power to the coil 2110 is stopped, the generation of a magnetic force by the coil 2110 may be stopped.

When the generation of a magnetic force by the coil 2110 is stopped, the first movable core 2140 may be moved by an elastic force of the first return spring 2130 in a direction (a down direction in the drawing) deviating from the fixed core 2120.

In this process, the first return spring 2130 may be discharged between the fixed core 2120 and the first movable core 2140.

The first shaft 2150 may be moved by a movement of the first movable core 2140 in a direction (a down direction in the drawing) where the other end 2154 of the first shaft 2150 becomes closer to the fixed core 2120.

The first moving contact 2230 may be moved by the movement of the first shaft 2150 in a direction (a down direction in the drawing) deviating from the fixed contacts 2210 and 2220, and thus may be detached from the fixed contacts 2210 and 2220.

When the generation of a magnetic force by the coil 2110 is stopped, the second movable core 2170 may be moved by an elastic force of the second return spring 2160 in a direction (a down direction in the drawing) deviating from the fixed core 2120.

In this process, the second return spring 2160 may be discharged between the fixed core 2120 and the second movable core 2170.

The second shaft 2180 may be moved by a movement of the second movable core 2170 in a direction (a down direction in the drawing) where the other end 2184 of the second shaft 2180 becomes closer to the fixed core 2120.

The second moving contact 2240 may be moved by the movement of the second shaft 2180 in a direction (an up direction in the drawing) deviating from the fixed contacts 2210 and 2220, and thus may be detached from the fixed contacts 2210 and 2220.

When the first moving contact 2230 and the second moving contact 2240 are detached from the fixed contacts 2210 and 2220, a circuit may be broken. That is, power which is supplied from the power source to the load through the first moving contact 2210, the first moving contact 2230, the second moving contact 2240, and the second moving contact 2220 may be cut off.

Here, in the relay 2000 according to another embodiment of the present invention, a current may flow through the first current flow path C1 and the second current flow path C2.

Therefore, a level of a current flowing through one flow current path may be lowered.

When the level of the current is lowered, the inter-electron repulsion proportional to the square of the level of the current may be more reduced than a degree to which the level of the current is lowered.

As a result, the first moving contact 2230 and the second moving contact 2240 are prevented from being detached from the fixed contacts 2210 and 2220 by the inter-electron repulsion.

In the relay 2000 according to another embodiment of the present invention, a first magnetic field B1 may be generated by the current I1 which flows in the first current flow path C1.

The first magnetic field B1, as illustrated in FIG. 7, may act in a direction which is output from the second current flow path C1.

In the current I2 which flows from the first fixed contact 2210 to the second fixed contact 2220 (from a left side to a right side in the drawing) through the second current flow path C2, a Lorentz force F2 may be generated by the magnetic field B1. A direction of the Lorentz force F2 may be a direction (a down direction in the drawing) of Lorentz force based on Lorentz's left hand rule.

The second moving contact 2240 may be moved in a direction of the Lorentz force F2, and may contact the fixed contacts 2210 and 2220. Therefore, a contacting force between the second moving contact 2240 and the fixed contacts 2210 and 2220 further increases due to the Lorentz force F2.

Accordingly, the second moving contact 2240 can be prevented from being detached from the fixed contacts 2210 and 2220 by the inter-electron repulsion.

A second magnetic field B2 may be generated by the current I2 which flows in the second current flow path C2.

The second magnetic field B2, as illustrated in FIG. 7, may act in a direction entering the second current flow path C1.

In the current I1 which flows from the first fixed contact 2210 to the second fixed contact 2220 (from a left side to a right side in the drawing) through the first current flow path C1, a Lorentz force F1 may be generated by the magnetic field B2. A direction of the Lorentz force F1 may be a direction (a down direction in the drawing) of Lorentz force based on Lorentz's left hand rule.

The first moving contact 2230 may be moved in a direction of the Lorentz force F1, and may contact the fixed contacts 2210 and 2220. Therefore, a contacting force between the first moving contact 2230 and the fixed contacts 2210 and 2220 further increases due to the Lorentz force F2.

Accordingly, the first moving contact 2230 can be prevented from being detached from the fixed contacts 2210 and 2220 by the inter-electron repulsion.

In the relay 2000 according to an embodiment of the present invention, even without increasing the pickup voltage of the driver 2100 which drives the first moving contact 2230 and the second moving contact 2240, the first moving contact 2230 and the second moving contact 2240 can be prevented from being detached from the fixed contacts 2210 and 2220 by the inter-electron repulsion.

Therefore, electric energy used to drive the driver 2100 can be saved compared to when the driver 2100 is driven by increasing the pickup voltage.

In the relay 2000 according to an embodiment of the present invention, a current may flow in a straight-line direction in the first current flow path C1 which is formed as long as possible in a limit space.

Moreover, a current may flow in a straight-line direction in the second current flow path C2 which is formed as long as possible in the limit space.

Moreover, the current I1 flowing in the first current flow path C1 may flow in a direction vertical to the moving axis of the first moving contact 2230.

Moreover, the current I2 flowing in the second current flow path C2 may flow in a direction vertical to the moving axis of the second moving contact 2240.

Moreover, the current I1 flowing in the first current flow path C1 and the current I2 flowing in the second current flow path C2 may flow in parallel in the same direction.

At this time, a moving axis of the first moving contact 2230 and a moving axis of the second moving contact 2240 may be disposed on the same axis.

Therefore, a magnitude of the Lorentz force used to increase a contacting force between the first moving contact 2230 and the fixed contacts 2210 and 2220 can further increase, and moreover, a magnitude of the Lorentz force used to increase a contacting force between the second moving contact 2240 and the fixed contacts 2210 and 2220 can further increase.

This will now be described in more detail.

In the first moving contact 2230, the second moving contact 2240, and the fixed contacts 2210 and 2220, lengths of the first current flow path C1 and the second current flow path C2 may be formed as long as possible in the limit space.

Therefore, a part in which each of the Lorentz force F1 and the Lorentz force F2 is generated is enlarged, and thus, the magnitude of the Lorentz force F1 applied to the first moving contact 2230 and the magnitude of the Lorentz force F2 applied to the second moving contact 2240 can further increase.

The first moving contact 2230, the second moving contact 2240, and the fixed contacts 2210 and 2220 may be provided so that the current I1 flowing in the first current flow path C1 flows in a straight-line direction.

Moreover, the first moving contact 2230, the second moving contact 2240, and the fixed contacts 2210 and 2220 may be provided so that the current I2 flowing in the second current flow path C2 flows in a straight-line direction.

Therefore, a magnetic field B11 generated by the current I11 which flows in one side of the first moving contact 2230 may act on the second moving contact 2240 in the same direction as that of a magnetic field B12 generated by the current I12 which flows in the other side of the first moving contact 2230.

In other words, in addition to the magnetic field B11 generated by the current I11 which flows in the one side of the first moving contact 2230, the magnetic field B12 generated by the current I12 which flows in the other side of the first moving contact 2230 may act on the second moving contact 2240. A direction of the magnetic field B11 acting on the second moving contact 2240 may match a direction of magnetic field B12 acting on the second moving contact 2240.

Therefore, two the magnetic fields B11 and B12 may act on the second moving contact 2240 without being counteracted. Also, since the two magnetic fields B11 and B12 are summated, a magnitude of the first magnetic field B1 acting on the second moving contact 2240 increases.

As a result, the magnitude of the Lorentz force F2 acting on the second moving contact 2240 can further increase.

With the same principle, a magnetic field B21 generated by the current I21 which flows in one side of the second moving contact 2240 may act on the first moving contact 2230 in the same direction as that of a magnetic field B22 generated by the current I22 which flows in the other side of the second moving contact 2240.

In other words, in addition to the magnetic field B21 generated by the current I21 which flows in the one side of the second moving contact 2240, the magnetic field B22 generated by the current I22 which flows in the other side of the second moving contact 2240 may act on the first moving contact 2230. A direction of the magnetic field B21 acting on the first moving contact 2230 may match a direction of magnetic field B22 acting on the first moving contact 2230.

Therefore, two the magnetic fields B21 and B22 may act on the first moving contact 2230 without being counteracted. Also, since the two magnetic fields B21 and B22 are summated, a magnitude of the second magnetic field B2 acting on the first moving contact 2230 increases.

As a result, the magnitude of the Lorentz force F1 acting on the first moving contact 2230 can further increase.

The first moving contact 2230, the second moving contact 2240, and the fixed contacts 2210 and 2220 may be provided so that the current I1 flowing in the second current flow path C1 flows in a direction vertical to the moving axis of the first moving contact 2230.

Moreover, the first moving contact 2230, the second moving contact 2240, and the fixed contacts 2210 and 2220 may be provided so that the current I2 flowing in the first current flow path C2 flows in the direction vertical to the moving axis of the second moving contact 2240.

Moreover, the first moving contact 2230, the second moving contact 2240, and the fixed contacts 2210 and 2220 may be provided so that the current I1 flowing in the first current flow path C1 and the current I2 flowing in the second current flow path C2 flow in parallel in the same direction.

At this time, the moving axis of the first moving contact 2230 and the moving axis of the second moving contact 2240 may be disposed on the same axis.

Therefore, an intensity of the magnetic field B2 acting on the first moving contact 2230 may be uniform and high in an entire portion of the first moving contact 2230.

Moreover, a direction of the magnetic field B2 acting on the first moving contact 2230 may be vertical to a direction of the current I1 passing through the first moving contact 2230. A contact direction of the first moving contact 2230 may match a direction of the Lorentz force F1 which is vertical to the direction of the magnetic field B2 acting on the first moving contact 2230 and the direction of the current I1 passing through the first moving contact 2230.

Therefore, the Lorentz force F1 which is generated by the magnetic field B2 acting on the first moving contact 2230 and the current I1 flowing in the first moving contact 2230 is maximized, and the maximized Lorentz force F1 is used to increase a contacting force between the first moving contact 2230 and the fixed contacts 2210 and 2220.

Moreover, an intensity of the magnetic field B1 acting on the second moving contact 2240 may be uniform and high in an entire portion of the second moving contact 2240. Also, a direction of the magnetic field B1 acting on the second moving contact 2240 may be vertical to a direction of the current I2 passing through the second moving contact 2240. A contact direction of the second moving contact 2240 may match a direction of the Lorentz force F2 which is vertical to the direction of the magnetic field B1 acting on the second moving contact 2240 and the direction of the current I2 passing through the second moving contact 2240.

Therefore, the Lorentz force F2 which is generated by the magnetic field B1 acting on the second moving contact 2240 and the current I2 flowing in the second moving contact 2240 is maximized, and the maximized Lorentz force F2 is used to increase a contacting force between the second moving contact 2240 and the fixed contacts 2210 and 2220.

As described above, according to the embodiments of the present invention, since a current is divided and flows between a fixed contact and a moving contact, the inter-electron repulsion can be reduced, and a Lorentz force generated by the divided current can increase a contacting force between the moving contact and the fixed contact. Therefore, the moving contact can be prevented from being detached from the fixed contact by the inter-electron repulsion.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A relay comprising:

a first fixed contact connected to a power source;

a second fixed contact separated from the first fixed contact, and connected to a load; and a moving contact configured to be brought into contact with or separated from the first fixed contact and the second fixed contact, wherein the moving contact comprises:

a first moving contact configured to be brought into contact with or separated from the first fixed contact and the second fixed contact; and a second moving contact separated from the first moving contact, and configured to be brought into contact with or separated from the first fixed contact and the second fixed contact, wherein, the first fixed contact comprises:

a first body part to which a current is applied; and a first arm part configured to protrude from the first body part toward the second fixed contact, the second fixed contact comprises:

a second body part configured to output a current; and a second arm part configured to protrude from the second body part toward the first fixed contact, the first moving contact contacts the first body part and the second body part in a state where the first moving contact is separated from the first arm part and the second arm part, and the second moving contact protrudes from the first moving contact to the first arm part and the second arm part, and contacts the first arm part and the second arm part.

2. The relay of claim 1, wherein, when the first moving contact and second moving contact contact the first fixed contact and the second fixed contact, a Lorentz force is applied to the first moving contact by a current passing through the first moving contact and a current passing through the second moving contact, and the first moving contact is moved in the same direction as a direction of the Lorentz force applied to the first moving contact, and contacts the first fixed contact and the second fixed contact.

3. The relay of claim 2, wherein, the first moving contact and the second moving contact are driven by a driver, and the driver comprises:

a coil configured to generate a magnetic force with power applied thereto to form a magnetic field space;

a fixed core fixedly disposed in the magnetic field space;

a movable core movably disposed in the magnetic field space to approach or be separated from the fixed core; and a shaft configured to connect the movable core to the first moving contact and the second moving contact.

4. The relay of claim 3, wherein the shaft comprises:

a first contact spring configured to support the first moving contact; and a second contact spring configured to support the second moving contact.

5. The relay of claim 1, wherein, one of the first body part and the first moving contact comprises a first contact end portion that protrudes toward the other of the first body part and the first moving contact, one of the second body part and the first moving contact comprises a second contact end portion that protrudes toward the other of the second body part and the first moving contact, the first arm part protrudes from one side of the first body part which is separated from the first moving contact when the first moving contact contacts the first body part, the second arm part protrudes from one side of the second body part which is separated from the first moving contact when the first moving contact contacts the second body part, a through hole, through which the second moving contact passes, is formed at one side of the first moving contact, and the second moving contact protrudes from the first moving contact to the first arm part and the second arm part.

6. The relay of claim 5, wherein the first fixed contact, the second fixed contact, and the first moving contact are provided so that when the first moving contact and the second moving contact contact the first fixed contact and the second fixed contact, the first moving contact is provided close to the first arm part and the second arm part within a range in which a current does not flow between the first moving contact and the first arm part and between the first moving contact and the second arm part.

7. The relay of claim 5, wherein, the first arm part, the second arm part, and the first moving contact are provided vertically to a moving axis of the first moving contact, and the first moving contact is disposed in parallel with the first arm part and the second arm part.

8. The relay of claim 5, wherein, the first arm part and the second arm part protrude in an axial direction crossing the first body part and the second body part, and the first moving contact extends in one axis direction.

9. The relay of claim 5, wherein, the first arm part, the second arm part, and the first moving contact are long formed within a range which is allowed in a limit space, the first contact end portion is provided at or contacts one side of the first body part which is farthest away from an end of the first arm part, the second contact end portion is provided at or contacts one side of the second body part which is farthest away from an end of the second arm part, and the second moving contact contacts the end of the first arm part and the end of the second arm part.

* * * * *